US005943941A

United States Patent [19]

Kato et al.

[11] Patent Number: 5,943,941

[45] Date of Patent: Aug. 31, 1999

[54] RECIPROCATING COMPRESSOR

[75] Inventors: Masafumi Kato; Akichika Ito, both of Kariya, Japan

[73] Assignee: Kabushiki Kaisha Toyoda Jidoshokki, Seisakusho, Kariya, Japan

[21] Appl. No.: 08/981,695

[22] PCT Filed: May 8, 1996

[86] PCT No.: PCT/JP96/01216

§ 371 Date: Jan. 6, 1998

§ 102(e) Date: Jan. 6, 1998

[87] PCT Pub. No.: WO97/42411

PCT Pub. Date: Nov. 13, 1997

[30] Foreign Application Priority Data

Mar. 7, 1995 [JP] Japan ..... 7-047192

[51] Int. Cl.[6] ..... F01B 13/04

[52] U.S. Cl. ..... 92/12.2; 92/57; 92/71; 417/222.1; 417/269

[58] Field of Search ..... 92/12.2, 57, 71; 417/269, 227.1, 227.2

[56] References Cited

U.S. PATENT DOCUMENTS

| | | | |
|---|---|---|---|
| 4,037,522 | 7/1977 | Inoshita et al. | 92/71 |
| 4,244,679 | 1/1981 | Nakayama et al. | 92/71 X |
| 4,263,814 | 4/1981 | Takaoka et al. | 92/71 X |
| 4,283,997 | 8/1981 | Takahashi et al. | 417/269 X |
| 5,056,417 | 10/1991 | Kato et al. | 92/41 |
| 5,655,432 | 8/1997 | Wilkosz et al. | 92/71 |

FOREIGN PATENT DOCUMENTS

| | | |
|---|---|---|
| 6016513 | 8/1981 | Japan . |
| 135190 | 3/1982 | Japan . |
| 57-174770 | 11/1982 | Japan . |
| 60-16513 | 4/1985 | Japan . |
| 34751 | 2/1986 | Japan . |
| 1-35190 | 7/1989 | Japan . |
| 3-4751 | 1/1991 | Japan . |

*Primary Examiner*—Hoang Nguyen
*Attorney, Agent, or Firm*—Morgan & Finnegan, L.L.P.

[57] ABSTRACT

A compressor has pistons slidably housed in cylinder bores. Respective shoes slide against each of the pistons and a swash plate or cam to convert rotation of the swash plate to reciprocation of the pistons. Each piston has a recess for slidably receiving the shoe. A friction reducing layer containing tin as a major component is formed between the shoe and the piston. Additionally, a tin-based layer may be formed between the shoe and the swash plate.

16 Claims, 6 Drawing Sheets

RECIPROCATING COMPRESSOR

TECHNICAL FIELD

The present invention relates generally to a reciprocating compressor, which converts rotation of a drive shaft to reciprocating motion of pistons, and more particularly, to a structure for reducing sliding resistance occurring at cam-piston joints.

BACKGROUND ART

A reciprocating compressor, for example, as shown in FIG. 10, is typically employed in air conditioners for automobiles and the like. This compressor has a pair of cylinder blocks 30 and 31 combined with each other. A swash plate chamber 32 is defined between these cylinder blocks 30 and 31. Housings 35 and 36 are attached to the outer end faces of the cylinder blocks 30 and 31 via valve plates 33 and 34, respectively. An intake chamber 37 and a discharge chamber 38 are defined between the valve plate 33 and the housing 35 and also between the valve plate 34 and the housing 36.

The drive shaft 39 is rotatably supported in these cylinder blocks 30 and 31. A swash plate 40 serving as a cam is fixed, in the swash plate chamber 32, to the drive shaft 39. Plural pairs of cylinder bores 41 and 42 are defined in the cylinder blocks 30 and 31 around the drive shaft 39. A double-headed piston 43 is housed in each pair of cylinder bores 41 and 42. Shoes 44, which serve as cam followers, are located between the swash plate 40 and each piston 43. Each shoe 44 has a sliding surface 45 that makes sliding contact with the front face or rear face of the swash plate 40 and a spherical surface 47 that makes sliding contact with a receiving recess 46 of the piston 43.

In the compressor described above, when the swash plate 40 is rotated with the rotation of the drive shaft 39, each piston 43 is reciprocated in the cylinder bores 41, 42 via the shoes 44 under the action of the swash plate 40. When the piston 43 is reciprocated, a refrigerant gas is introduced from the intake chamber 37 to the cylinder bores 41 and 42 as each piston 43 moves from the top dead center to the bottom dead center. Then, the refrigerant gas introduced into the cylinder bores 41 and 42 is compressed as the piston 43 moves from the bottom dead center to the top dead center and is discharged to the discharge chamber 38.

Generally, in order to increase the discharge capacity of a compressor, increasing the size of the cylinder bores 41 and 42 and increasing the sizes of the pistons 43, swash plate 40 and shoes 44 is contemplated. The pistons 43 and the swash plate 40 are generally made of a light aluminum alloy or the like. However, these members, which are made of the same metallic material, may seize. Accordingly, shoes 44 made of a ferrous metal are located between the pistons 43 and the swash plate 40 to prevent seizure between the pistons 43 and the swash plate 40. However, since ferrous metals have high specific gravity, the increase in the size of the shoes 44 increases the total weight of the compressor.

Assume that only the size of the pistons 43 and that of the swash plate 40 are increased, without changing the size of the shoes 44, in order to increase the discharge capacity. However, if the discharge capacity is increased, the load applied by the pistons 43 via the shoes 44 to the swash plate 40 is also increased. Accordingly, if the size of the shoes 44 remains unchanged, the load applied per unit area of the spherical surfaces 47 and that of the sliding surfaces 45 of the shoes 44 is increased. Consequently, the sliding resistance between the spherical surfaces 47 of the shoes 44 and the receiving recesses 46 defined in the pistons 43 and the sliding resistance between the sliding surfaces 45 of the shoes 44 and the swash plate 40 are increased.

If the sliding resistance between the spherical surfaces 47 of the shoes 44 and the receiving recesses 46 of the piston 43 is increased, the shoes 44 cannot move smoothly along the inner surfaces of the shoe retaining recesses 46. The shoes are moved by the swash plate 40 within the receiving recesses 46. If the shoes cannot move smoothly, the load applied between the sliding surfaces 45 of the shoes 44 and the swash plate 40 is increased, which further increase the sliding resistance between the sliding surfaces 45 of the shoes 44 and the swash plate 40.

In the compressor described above, a refrigerant gas is introduced from an external refrigerant circuit via the swash plate chamber 32 into the intake chamber 37. The refrigerant gas introduced into the swash plate chamber 32 cools each part in the swash plate chamber 32 and also prevents pulsation caused by the introduction of the refrigerant into the cylinder bores 41 and 42. However, R134*a* ($CF_3CH_2F$), which contains no chlorine, is employed as the refrigerant gas. This gas does not disrupt the stratospheric ozone layer. Chlorine is used as an extreme-pressure additive. An "extreme-pressure additive" is a substance that reacts with the surface of a metal and forms a metallic compound film to reduce frictional resistance. The refrigerant gas introduced into the swash plate chamber 32 washes off, by its own action, lubricant located on the surfaces of the swash plate 40 and other parts, so that lubrication between the shoes 44 and the pistons 43 and swash plate 40 is not easily achieved. In such cases, if chlorine, serving as the extreme-pressure additive, is not present in the refrigerant gas molecules, a great sliding resistance exists.

Therefore, it is an objective of the present invention to provide a reciprocating compressor that reduces the sliding resistance at the cam-piston joints.

SUMMARY OF THE INVENTION

In order to attain the objective described above, the compressor according to the present invention has cylinder blocks containing cylinder bores. A drive shaft is rotatably supported in the cylinder blocks. A cam is attached to the drive shaft to be rotatable integrally therewith. A piston is slidably housed in the cylinder bores. A cam follower is slidably held between the piston and the cam. As the cam rotates, the piston is reciprocated via the cam follower. The piston is made of an aluminum or aluminum alloy matrix. The piston contains a receiving portion for slidably receiving the cam follower therein. A coating layer containing tin as a major component is formed at the receiving portion of the piston.

Therefore, according to the present invention, the coating layers formed at the receiving portions of the pistons reduce sliding resistance between the receiving portions of the pistons and the cam followers. Accordingly, even if a shortage of a lubricant occurs in the compressor, the cam followers can slide smoothly in the receiving portions of the pistons. Thus, the cam can move the cam followers with a small force. Consequently, the load acting between the cam followers and the cam can be reduced to decrease sliding resistance between them.

DETAILED DESCRIPTION OF THE PREFERRED EMBODIMENTS (First embodiment)

Figure 10:
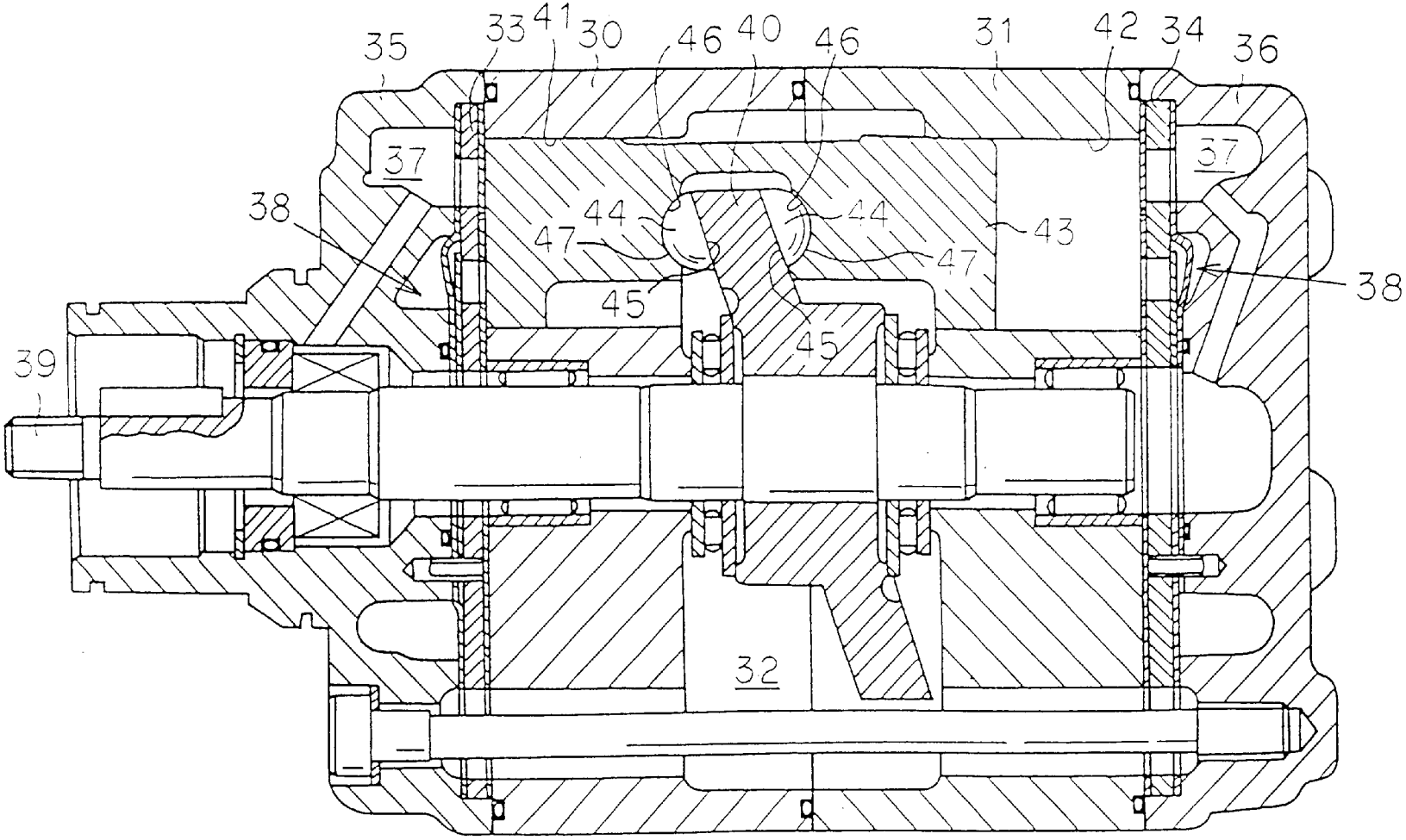
FIG. 10 is a cross-sectional view of a prior art swash-plate type compressor.

A swash plate type compressor according to a first embodiment of the present invention will be described below referring to FIG. 1. to FIG. 4. It should be noted here that the mechanical construction of the compressor of the first embodiment is substantially the same as that of the compressor shown in FIG. 10, which was described with reference to the prior art. Therefore, like or the same components as those in the compressor shown in FIG. 10 are affixed with the same reference numbers, respectively, and a description of them will be omitted. Therefore, only differences from the compressor shown in FIG. 10 will be described.

Figure 1:
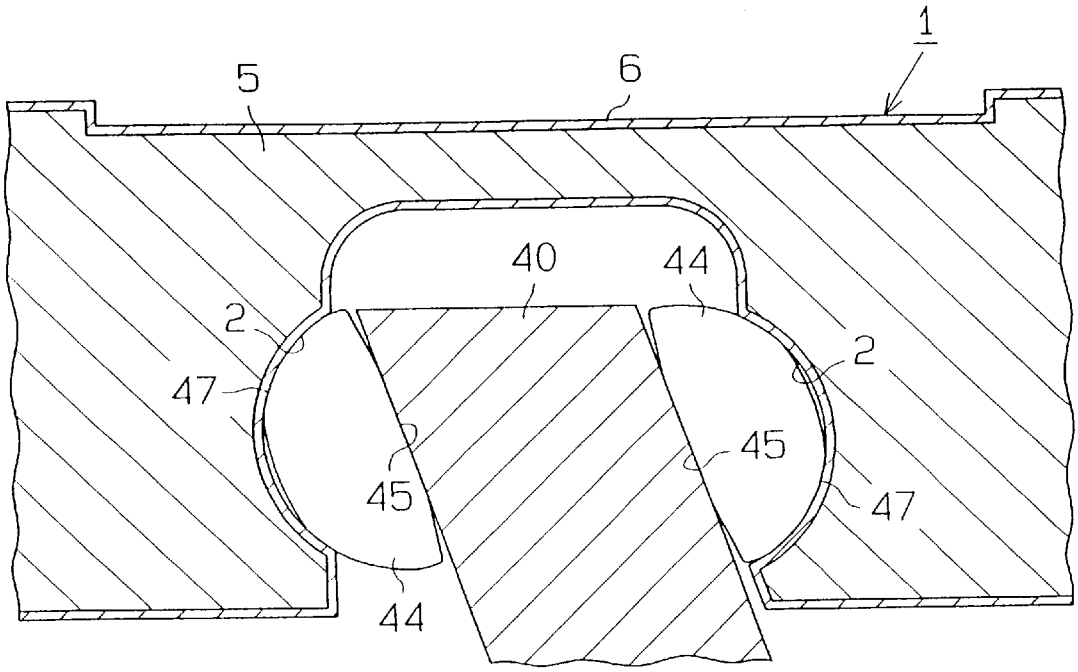
FIG. 1 is an enlarged cross-sectional view of a pertinent portion of a swash plate type compressor according to a first embodiment of the present invention.
Figure 2:
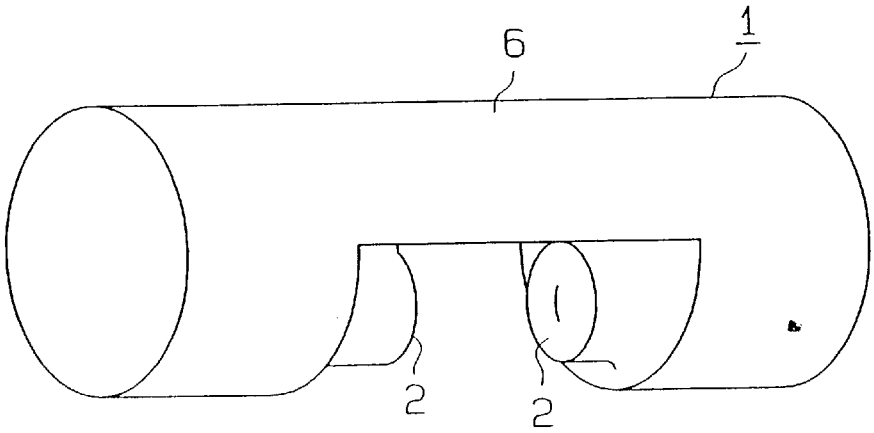
FIG. 2 is a perspective view showing a piston in the first embodiment.
Figure 3:
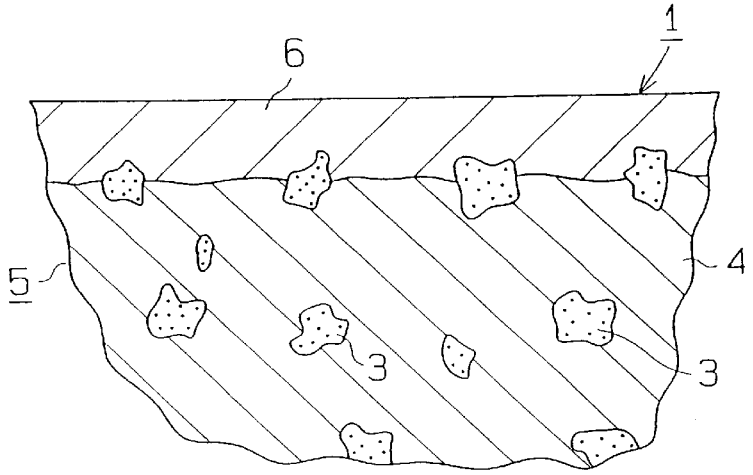
FIG. 3 is an enlarged cross-sectional view of a pertinent portion of the piston.

As shown in FIGS. 1 to 3, the compressor according to the first embodiment, unlike the compressor shown in FIG. 10, each piston 1 has a coating layer 6 containing containing more than 90% tin by weight formed over its entire surface. Each piston 1 has a pair of receiving recesses 2 which slidably receive spherical surfaces of shoes 44.

The piston 1 consists of a main body 5 made of an aluminum or aluminum alloy matrix and a coating layer 6 formed over the entire surface of the main body 5. As the aluminum alloy, for example, an Al—Si alloy or an Al—Si—Cu alloy can be suitably employed. The main body 5 is preferably an aluminum alloy matrix containing hard particles. Such aluminum alloy is typified by an aluminum-high silicon alloy. The aluminum-high silicon alloy contains about 10 to 30% by weight of silicon. If the aluminum-high silicon alloy has a silicon content not exceeding the level at which a eutectic mixture is formed, the silicon can be present in the form of eutectic silicon (i.e., the hard particles). In the first embodiment, the main body 5 of the piston 1 is made of a matrix of aluminum-high silicon alloy 4 containing 12% by weight of silicon 3.

Incidentally, other materials containing hard particles include, an Al—Mn intermetallic compound, an Al—-Si—Mn intermetallic compound, an Al—Fe—Mn intermetallic compound and an Al—Cr intermetallic compound, and these materials may be used as the matrix of the main body 5.

Further, in the first embodiment, the shoes 44 are made of SUJ2 material (a steel material for a high carbon content chromium bearing) specified by JIS, while the swash plate 40 is made of an aluminum-high silicon alloy.

The pistons 1 to be employed in the compressor of the first embodiment may be suitably selected, for example, from Examples 1 to 9 having various type of coating layers 6, respectively, as described below. Pistons 1 of Examples 1 to 9 will be described one by one. In Examples 1 to 9, the main bodies 5 of the pistons 1 are of the same structure, and the coating layers 6 have different compositions.

EXAMPLE 1

The piston 1 of Example 1 has a tin-copper eutectoid plating layer as the coating layer 6. This coating layer 6 is formed as follows. The entire main body 5 is immersed in an aqueous solution containing 6% by weight of potassium stannate and 0.012% by weight of copper gluconate maintained at 60 to 80° C. is to effect electroless plating on the surface of the main body 5. Subsequently, the main body 5 is taken out of the aqueous solution and rinsed. Thus, a eutectoid plating layer of tin and copper is formed as the coating layer 6 over the entire surface of the piston 1, including the receiving recesses 2, which contact the shoes 44. The coating layer 6 contains 97% by weight of tin and 3% by weight of copper and has a thickness of 1.2 $\mu$m.

EXAMPLE 2

The piston 1 of Example 2 has a tin-nickel eutectoid plating layer as the coating layer 6. Specifically, a eutectoid plating layer of tin and nickel is formed as the coating layer 6 over the entire surface of the piston 1 including the receiving recesses 2 by employing an aqueous solution containing 6% by weight of potassium stannate and 0.005% by weight of nickel chloride in the same manner as in Example 1. The coating layer 6 contains 98% by weight of tin and 2% by weight of nickel and has a thickness of 1 $\mu$m.

EXAMPLE 3

The piston 1 of Example 3 has a tin-zinc eutectoid plating layer as the coating layer 6. Specifically, a eutectoid plating layer of tin and zinc is formed as the coating layer 6 over the entire surface of the piston 1 including the receiving recesses 2 by employing an aqueous solution containing 6% by weight of potassium stannate and 0.005% by weight of zinc sulfate in the same manner as in Example 1. The coating layer 6 contains 97% by weight of tin and 3% by weight of zinc and has a thickness of 1 $\mu$m.

EXAMPLE 4

The piston 1 of Example 4 has a tin-lead eutectoid plating layer as the coating layer 6. Specifically, a eutectoid plating layer of tin and lead is formed as the coating layer 6 over the entire surface of the piston 1 including the receiving recesses 2 by employing an aqueous solution containing 6% by weight of potassium stannate and 0.007% by weight of lead sulfate in the same manner as in Example 1. The coating layer 6 contains 95% by weight of tin and 5% by weight of lead and has a thickness of 2 $\mu$m.

EXAMPLE 5

The piston 1 of Example 5 has a tin-indium eutectoid plating layer as the coating layer 6. Specifically, a eutectoid plating layer of tin and indium is formed as the coating layer 6 over the entire surface of the piston 1 including the receiving recesses 2 by employing an aqueous solution containing 6% by weight of potassium stannate and 0.005% by weight of indium sulfate in the same manner as in Example 1. The coating layer 6 contains 97% by weight of tin and 3% by weight of indium and has a thickness of 1 $\mu$m.

EXAMPLE 6

The piston 1 of Example 6 has a plating layer containing only tin as the coating layer 6. Specifically, a plating layer of only tin is formed as the coating layer 6 over the entire surface of the piston 1 including the receiving recesses 2 by employing an aqueous solution containing 6% by weight of potassium stannate in the same manner as in Example 1. The coating layer 6 has a thickness of 1.5 μm.

EXAMPLE 7

The piston 1 of Example 7 has, as the coating layer 6, a tin-copper eutectoid plating layer containing a fluororesin powder as a solid lubricant. Specifically, a eutectoid plating layer of tin and copper containing a fluororesin powder is formed as the coating layer 6 over the entire surface of the piston 1 including the receiving recesses 2 by employing an aqueous solution containing 6% by weight of potassium stannate, 0.003% by weight of copper gluconate and 1.0% by weight of a fluororesin powder in the same manner as in Example 1. The coating layer 6 contains 99% by weight of tin, 0.9% by weight of copper and 0.1% by weight of the fluororesin powder and has a thickness of 1.4 μm.

EXAMPLE 8

While the piston 1 of Example 8 has a tin-copper eutectoid plating layer like the coating layer 6 in Example 1, the coating layer 6, which is formed by chemical plating treatment in the same manner as in Example 1, is subjected to heat treatment at a temperature of 150° C. for one hour.

EXAMPLE 9

The piston 1 of Example 9 has a tin-copper-zinc eutectoid plating layer as the coating layer 6. Specifically, a eutectoid plating layer of tin, copper and zinc is formed as the coating layer 6 over the entire surface of the piston 1, including the receiving recesses 2, by employing an aqueous solution containing 6% by weight of potassium stannate, 0.003% by weight of copper gluconate and 0.003% by weight of zinc sulfate in the same manner as in Example 1. The coating layer 6 contains 97% by weight of tin, 1.5% by weight of copper and 1.5% by weight of zinc and has a thickness of 1.2 μm.

The present inventors performed the following test so as to confirm anti-seizure performance of compressors using the pistons 1 of Examples 1 to 9 respectively. In this test, the time until seizure between the swash plate 40 and the shoes 44 was measured while each compressor, which was incorporated into an automotive air conditioner, was operated under severe conditions (where no lubricant is present in the compressor). The compressors were operated in this test under the following conditions; intake pressure: −0.5 kg/cm$^2$, discharge pressure: 3 kg/cm$^2$, revolutions of the drive shaft 39: 1000 rpm. Further, the shoes 44 were made of an SUJ2 (JIS) material, and the swash plates 40 were made of an aluminum-high silicon alloy. Further, in carrying out this test, a compressor using pistons made only of an aluminum-high silicon alloy 4 containing 12% by weight of silicon 3, i.e., pistons having no coating layer 6, was provided as a comparative example and tested in the same manner as described above.

Figure 4:
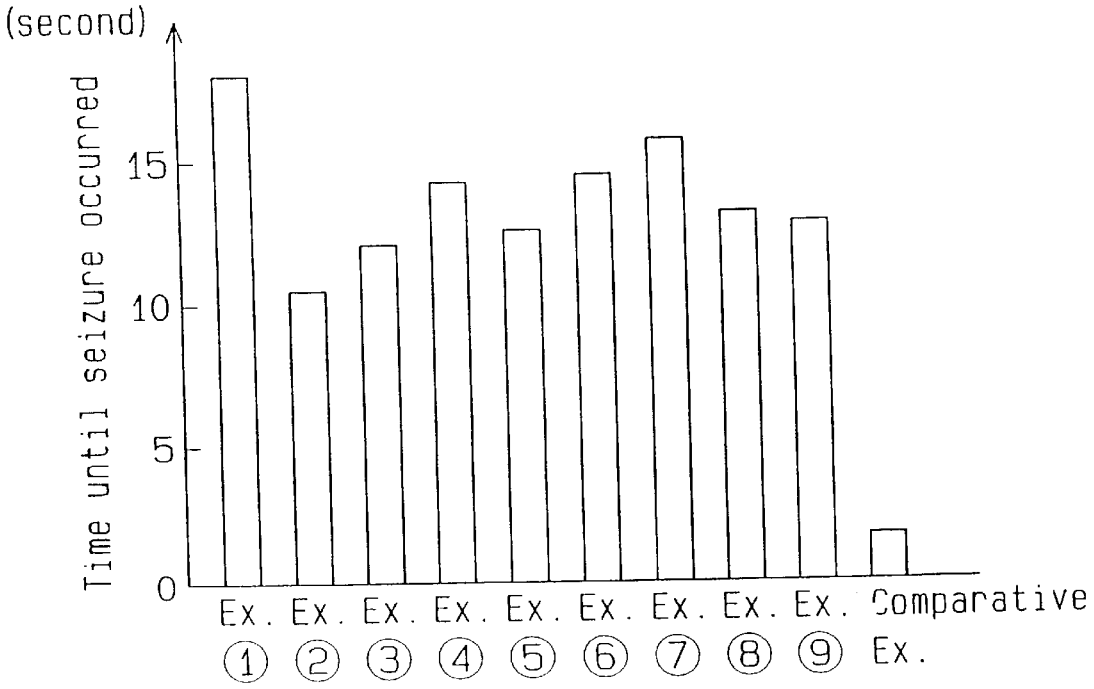
FIG. 4 is a graph showing measurement results of time until seizure that occurred with the first embodiment.

FIG. 4 is a graph showing the results of this test. The test results shown in FIG. 4 demonstrate that seizure between the shoes 44 and the swash plates 40 takes much longer under severe use conditions in the compressors employing the pistons 1 of Examples 1 to 9 having the coating layers 6 compared with the compressor of the comparative example. In particular, the compressor incorporated with the pistons 1 of Example 1, each having a tin-copper eutectoid plating layer as the coating layer 6, shows the best anti-seizure performance.

As described above, in the first embodiment, a coating layer 6 containing tin as a major component is formed on the surface of each piston 1. Tin is a self-lubricating substance. Accordingly, sliding resistance between the receiving recesses 2 of the piston 1 and the spherical surfaces 47 of the shoes 44 is reduced, and even when there is a shortage of lubricant in the compressor, the shoes 44 can move smoothly along the inner surfaces of the receiving recesses 2. Accordingly, the swash plate 40 can move the shoes 44 within the receiving recesses 2 with a small force. As a result, the load acting between the sliding surface 45 of each shoe 44 and the swash plate 40 is moderated to reduce sliding resistance between the sliding surface 45 and the swash plate 40. Therefore, when the discharge capacity of a compressor is to be increased, even if the sizes of the pistons 1 and of the swash plate 40 are increased without increasing the size of the shoes 44, no problems arise due to an increase in the sliding resistance.

The coating layer 6 is formed over the entire surface of each piston 1. Accordingly, the sliding resistance between the outer circumference of the piston 1 and the inner circumferences of the cylinder bores 41 and 42 is reduced to allow smooth movement of the piston in the cylinder bores 41 and 42.

By incorporating at least one metal selected from copper, nickel, zinc, lead and indium in the coating layer 6 that contains tin as the major component, not only can the coating layer 6 be densified, but a hard metallic compound can be dispersed throughout the coating layer 6 to reinforce it. This reduces the coefficient of friction and abrasion resistance. For example, when copper is incorporated into the coating layer 6 that contains tin as the major component, the coating layer 6 is densified and a hard tin-copper compound ($Cu_6Sn_5$) is dispersed throughout the coating layer 6 to reinforce it.

The coating layer 6 is formed by means of chemical plating. With this chemical plating method, a eutectic mixture of tin and other metals, such as copper, can be easily deposited, and a solid lubricant, such as a fluororesin powder, can be easily incorporated into the coating layer 6.

Second embodiment

Next, a swash plate type compressor according to a second embodiment of the invention will be described referring to FIGS. 5 and 6. It should be noted here that the mechanical constitution of the compressor of the second embodiment is substantially the same as that of the compressor shown in FIG. 10 described referring to the prior art. Therefore, like or the same components as those in the compressor shown in FIG. 10 are affixed with the same reference numbers respectively, and description of them will be omitted. Therefore, only the differences from the compressor shown in FIG. 10 will be described.

Figure 5:
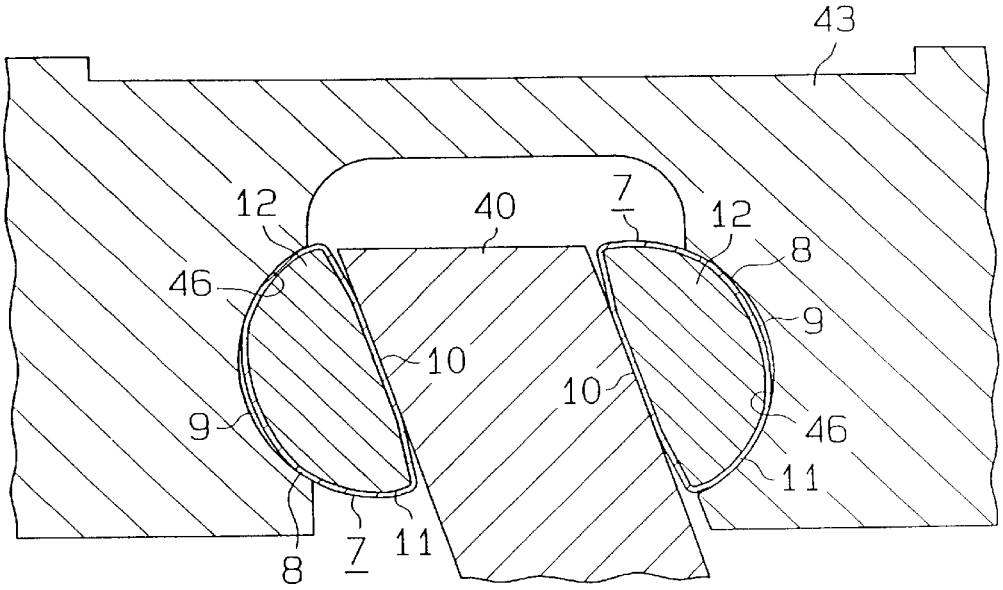
FIG. 5 is an enlarged cross-sectional view of a pertinent portion of a swash-plate type compressor according to a second embodiment of the invention.

As shown in FIG. 5, the compressor according to the second embodiment, unlike the compressor shown in FIG. 10, has shoes 7, each having a coating layer 11, containing tin as a major component, formed over its entire surface. The main body 12 of each shoe 7 is made of SUJ2 material as specified in JIS. The shoe 7 has a spherical surface 8 that slidably engages a receiving recess 46 of the piston 43 and a sliding surface 10, which makes sliding contact with the front face or rear face of the swash plate 40. The spherical surface 8 of the shoe 7 has a spherical portion 9 having a radius of curvature greater than that of the rest of the surface 8. An oil reservoir for storing a lubricant therein is defined between this spherical portion 9 and each receiving recess 46 of the piston 43. The sliding surface 10 of the shoe 7 is slightly tapered toward the periphery to have a convex-like shape to permit easy entry of lubricant into the clearance between the sliding surface 10 and the swash plate 40.

Further, in the second embodiment, both the swash plate 40 and the pistons 43 are made of an aluminum-high silicon alloy.

In the compressor of the second embodiment, suitable shoes 7 can be selected from those having various coating layers 11 as shown in the following Examples 1 to 9. The shoes 7 of Examples 1 to 9 will be described one by one. The main bodies 12 of the shoes 7 of Examples 1 to 9 are all the same, and only the coating layers 11 are different from one another.

EXAMPLE 1

The shoe 7 of Example 1 has a tin-copper eutectoid plating layer as the coating layer 11. This coating layer 11 is formed as follows. The main body 12 of the shoe 7 is immersed in an aqueous solution containing 6% by weight of potassium stannate and 0.012% by weight of copper gluconate. In this state, the main body 12 is connected to a cathode, and a metal bar having a high ionization tendency is used as an anode. When a predetermined voltage is applied between these electrodes using the thus prepared aqueous solution as an electrolyte, tin and copper are separated out under electrolytic action to adhere intimately to the surface of the main body 12. Subsequently, the main body 12 is taken out of the aqueous solution and rinsed. Thus, a eutectoid plating layer of tin and copper is formed as the coating layer 11 over the entire surface of the shoe 7. The shoe 7 thus plated is then surface polished while taking the clearance between the swash plate 40, with which the shoe 7 is used, and the piston 43 into consideration to have a uniform coating layer 11. The coating layer 11 contains 97% by weight of tin and 3% by weight of copper and has a thickness of 1.2 μm.

EXAMPLE 2

The shoe 7 of Example 2 has a tin-nickel eutectoid plating layer as the coating layer 11. Specifically, a eutectoid plating layer of tin and nickel is formed as the coating layer 11 over the entire surface of the shoe 7 by employing an aqueous solution containing 6% by weight of potassium stannate and 0.005% by weight of nickel chloride in the same manner as in Example 1. The coating layer 11 contains 98% by weight of tin and 2% by weight of nickel, and the thickness of the coating layer 11 is adjusted to 1 μm by surface polishing.

EXAMPLE 3

The shoe 7 of Example 3 has a tin-zinc eutectoid plating layer as the coating layer 11. Specifically, a eutectoid plating layer of tin and zinc is formed as the coating layer 11 over the entire surface of the shoe 7 by employing an aqueous solution containing 6% by weight of potassium stannate and 0.005% by weight of zinc sulfate in the same manner as in Example 1. The coating layer 11 contains 97% by weight of tin and 3% by weight of zinc, and the thickness of the coating layer 11 is adjusted to 1 μm by surface polishing.

EXAMPLE 4

The shoe 7 of Example 4 has a tin-lead eutectoid plating layer as the coating layer 11. Specifically, a eutectoid plating layer of tin and lead is formed as the coating layer 11 over the entire surface of the shoe 7 by employing an aqueous solution containing 6% by weight of potassium stannate and 0.007% by weight of lead sulfate in the same manner as in Example 1. The coating layer 11 contains 95% by weight of tin and 5% by weight of lead, and the thickness of the coating layer 11 is adjusted to 2 μm by surface polishing.

EXAMPLE 5

The shoe 7 of Example 5 has a tin-indium eutectoid plating layer as the coating layer 11. Specifically, a eutectoid plating layer of tin and indium is formed as the coating layer 11 over the entire surface of the shoe 7 by employing an aqueous solution containing 6% by weight of potassium stannate and 0.005% by weight of indium sulfate in the same manner as in Example 1. The coating layer 11 contains 97% by weight of tin and 3% by weight of indium, and the thickness of the coating layer 11 is adjusted to 1 μm by surface polishing.

EXAMPLE 6

The shoe 7 of Example 6 has a plating layer containing tin only as the coating layer 11. Specifically, a plating layer of tin only is formed as the coating layer 11 over the entire surface of the shoe 7 by employing an aqueous solution containing 6% by weight of potassium stannate in the same manner as in Example 1. The thickness of the coating layer 11 is adjusted to 1.5 μm by surface polishing.

EXAMPLE 7

The shoe 7 of Example 7 has a tin-copper eutectoid plating layer containing a molybdenum disulfide powder as a solid lubricant as the coating layer 11. Specifically, a eutectoid plating layer of tin and zinc containing the molybdenum disulfide powder is formed as the coating layer 11 over the entire surface of the shoe 7 by employing an aqueous solution containing 6% by weight of potassium stannate, 0.003% by weight of copper gluconate and 1.0% by weight of the molybdenum disulfide powder in the same manner as in Example 1. The coating layer 11 contains 99% by weight of tin, 0.9% by weight of copper and 0.1% by weight of the molybdenum disulfide powder, and the thickness of the coating layer 11 is adjusted to 1.4 μm by surface polishing.

EXAMPLE 8

While the shoe 7 of Example 8 has a tin-copper eutectoid plating layer as the coating layer 11 like in Example 1, the coating layer 11, which is formed by electrolytic plating treatment and polished in the same manner as in Example 1, is subjected to heat treatment at a temperature of 150° C. for one hour.

EXAMPLE 9

The shoe 7 of Example 9 has a tin-copper-zinc eutectoid plating layer as the coating layer 11. Specifically, a eutectoid plating layer of tin, copper and zinc is formed as the coating layer 11 over the entire surface of the shoe 7 by employing an aqueous solution containing 6% by weight of potassium stannate, 0.003% by weight of copper gluconate and 0.003% by weight of zinc sulfate in the same manner as in Example 1. The coating layer 11 contains 97% by weight of tin, 1.5% by weight of copper and 1.5% by weight of zinc, and the thickness of the coating layer 11 is adjusted to 1.2 μm by surface polishing.

The present inventors performed the following test to confirm the anti-seizure performance of compressors using the shoes 7 of Examples 1 to 9, respectively. In this test, the time until seizure between the swash plate 40 and the shoes 7 was measured while each compressor, which was incorporated into an automotive air conditioner, was operated under severe conditions (where no lubricant is present in the compressor). The compressors were operated continuously in this test under the following conditions; intake pressure: −0.5 kg/cm$^2$, discharge pressure: 3 kg/cm$^2$, revolutions of the drive shaft 39: 1000 rpm. Further, the swash plates 40 and the pistons 43 of the compressors were made of an aluminum-high silicon alloy. Further, in carrying out this test, a compressor using shoes made of an SUJ2 material only, i.e., shoes having no coating layer 11, was provided as a comparative example and tested in the same manner as described above.

Figure 6:
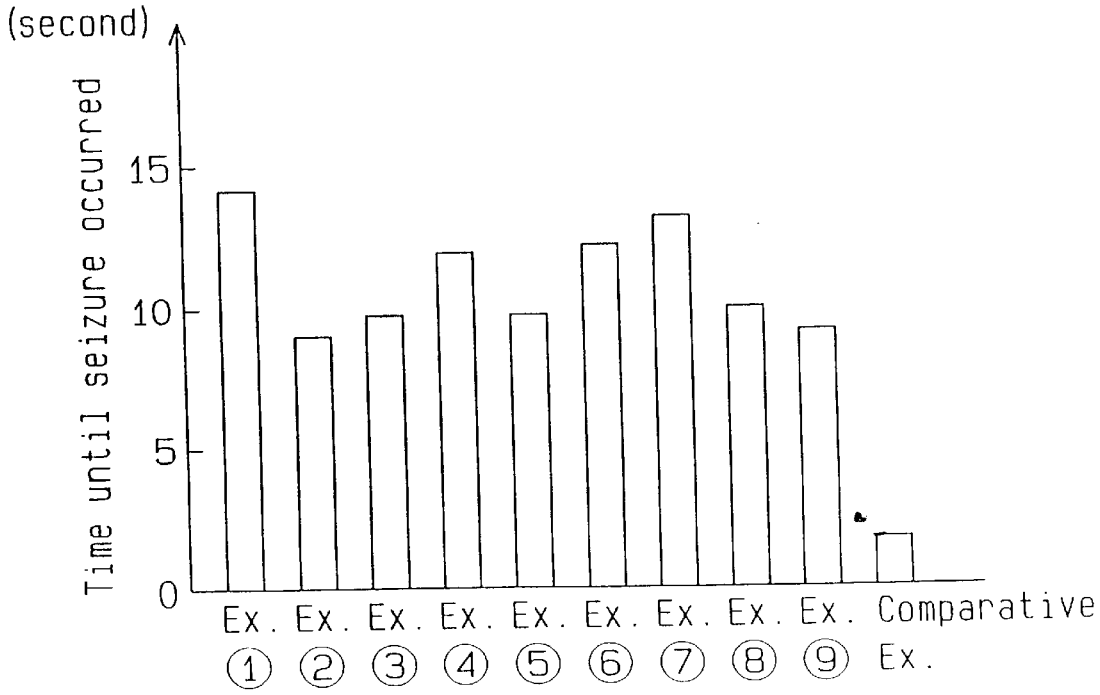
FIG. 6 is a graph showing measurement results of time until seizure that occurred with the second embodiment.

FIG. 6 is a graph showing the results of this test. The test results shown in FIG. 6 demonstrate that seizure between the shoes 7 and the swash plates 40 takes much longer under severe use conditions in the compressors employing the shoes 7 of Examples 1 to 9 having the coating layers 11 compared with the compressor of the comparative example. In particular, the compressor incorporated with the shoes 7 of Example 1, each having a tin-copper eutectoid plating layer as the coating layer 11, shows the best anti-seizure performance.

As described above, in the second embodiment, a coating layer 11 containing tin as a major component is formed on the surface of each shoe 7. Accordingly, sliding resistance between the receiving recesses 46 of the piston 43 and the spherical surfaces 8 of the shoes 7 is reduced, and the sliding resistance between the swash plate 40 and the sliding surface 10 of the shoe 7 is reduced. Accordingly, even when there is a shortage of lubricant in the compressor, smooth sliding of the swash plate 40 and the pistons 43 can be guarantied at the joints thereof to control sliding resistance at the joints.

The shoes 44 can move smoothly along the inner surfaces of the receiving recesses 46 under the action of the coating layer 11 formed on the spherical surfaces 8. As a result, the load acting between the sliding surface 10 of each shoe 7 and the swash plate 40 is moderated to reduce sliding resistance between the sliding surface 10 and the swash plate 40. The coating layer 11 is also present on the sliding surface 10 of the shoe 7, thus, the sliding resistance between the sliding surface 10 and the swash plate 40 can be further reduced. Therefore, when the discharge capacity of a compressor is to be increased, even if the sizes of the pistons 43 and the swash plate 40 are increased without changing the size of the shoes 7, no problems arise due to an increase in the sliding resistance.

Since tin not only exhibits excellent lubrication properties but also prevents rust, the coating layer 11 that contains tin as the major component formed on the surface of each shoe 7, which is made of a ferrous metal, can protect the shoe 7 from rusting.

Effects brought about by incorporating at least one metal selected from the group including copper to the coating layer 11 that contains tin as the major component are the same as in the first embodiment.

Figure 7:
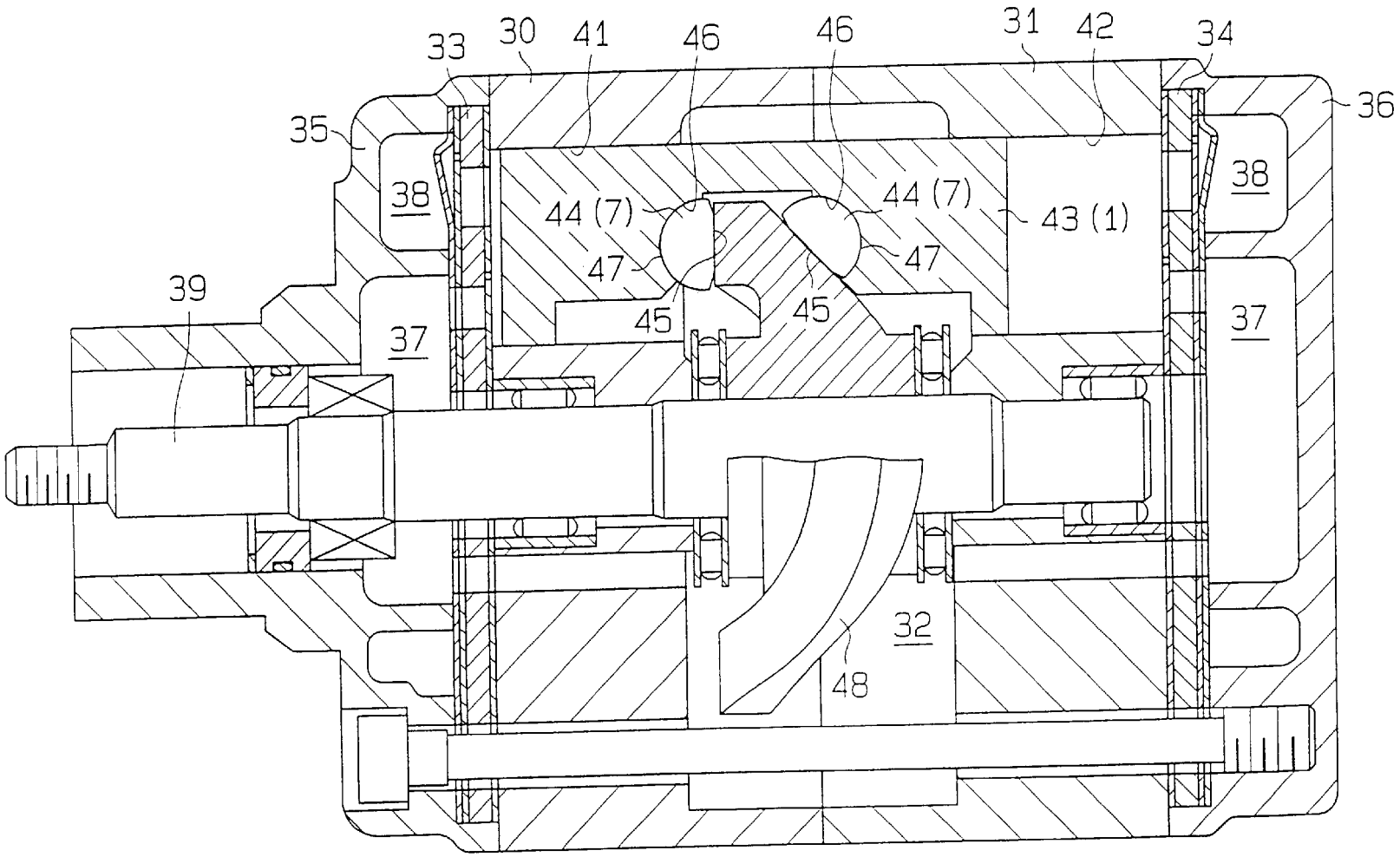
FIG. 7 is a cross-sectional view showing a wave cam type compressor according to another embodiment of the invention.

It should be understood that the present invention is not to be limited to the foregoing embodiments but may be embodied as follows by changing the make-up of the respective parts:

(1) In any of the first and second embodiments, while the present invention is embodied in a double-headed piston swash plate type compressor, the present invention may be embodied, for example, in a single-headed piston swash plate type compressor, a variable volume type compressor, which can adjust discharge volume by changing the tilt angle of the swash plate, a wave cam type compressor as shown in FIG. 7, or the like. Incidentally, in the wave cam type compressor shown in FIG. 7, like or the same components as those in the compressor shown in FIG. 10 are affixed with the same reference numbers, respectively, and description of them will be omitted. As shown in FIG. 7, this wave cam type compressor has a wave cam 48 having a wavy cam surface in place of the swash plate 40 in the compressor shown in FIG. 1. The sliding surface 45 of each shoe 44 is designed to make sliding contact with the front cam surface or rear cam surface of the wave cam 48.

In the wave cam type compressor described above, each piston 43 is adapted to reciprocate twice or more (twice in FIG. 7) per revolution of the drive shaft 39, and the shoes 44 are required to follow the complicated cam surfaces as the cam surfaces produce displacement. Accordingly, in wave cam type compressors, compared with the swash plate type compressors, the conditions between the shoes 44 and the pistons 43 and between the shoes 44 and the wave cam 48 are more harsh. Accordingly, a reduction in the sliding resistance occurring at the junction of the wave cam 48 and the pistons 43 is important so that the wave cam type compressor can perform stable compression.

In the compressor shown in FIG. 7, to reduce sliding resistance occurring at the joints between the wave cam 48 and the pistons 43, the pistons 43 may be replaced with the pistons 1 as described in the foregoing first embodiment, or the shoes 44 may be replaced with the shoes 7 as described in the foregoing second embodiment.

Figure 8:
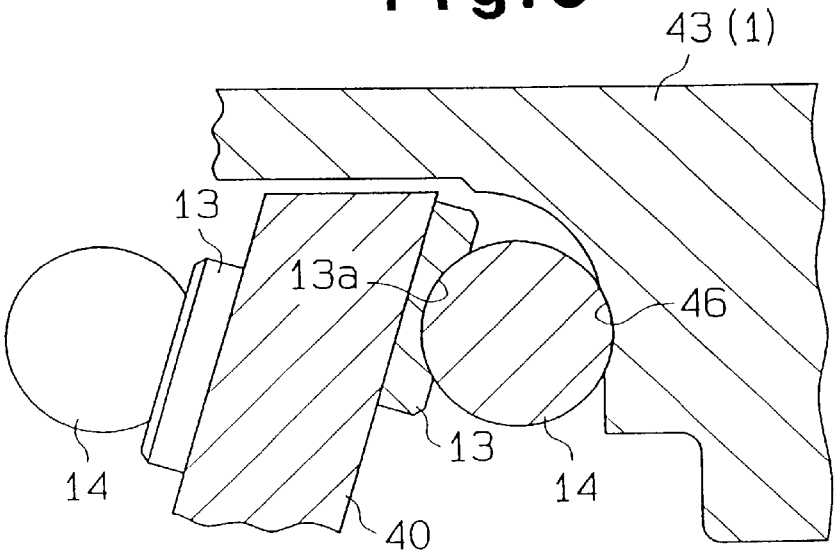
FIG. 8 is an enlarged cross-sectional view of a pertinent portion of a cam follower according to another embodiment of the invention.

(2) While substantially hemispherical shoes 7 and 44 were employed as cam followers in the first embodiment and the second embodiment, respectively, these shoes 77 and 44 may be replaced with a structure employing rollers. Otherwise, as shown in FIG. 8, each cam follower may consist of a slipper 13, which makes sliding contact with the swash plate 40, and a ball 14, which engages a recess 13*a* of the slipper 13. The ball 14 is slidably engaged in the receiving recess 46 of the piston 43. Incidentally, in FIG. 8, like or the same components as those in the compressor shown in FIG. 10 are affixed with the same reference numbers, respectively, and descriptions of them will be omitted. In the construction shown in FIG. 8, the pistons 43 may be replaced with the pistons 1 as described in the foregoing first embodiment, or the coating layer 11 as formed on the shoe 7 in the foregoing second embodiment may be formed on the slipper 13 or the ball 14 or both.

The construction of the cam follower shown in FIG. 8 may be applied to the above-described wave cam type compressor shown in FIG. 7.

Figure 9:
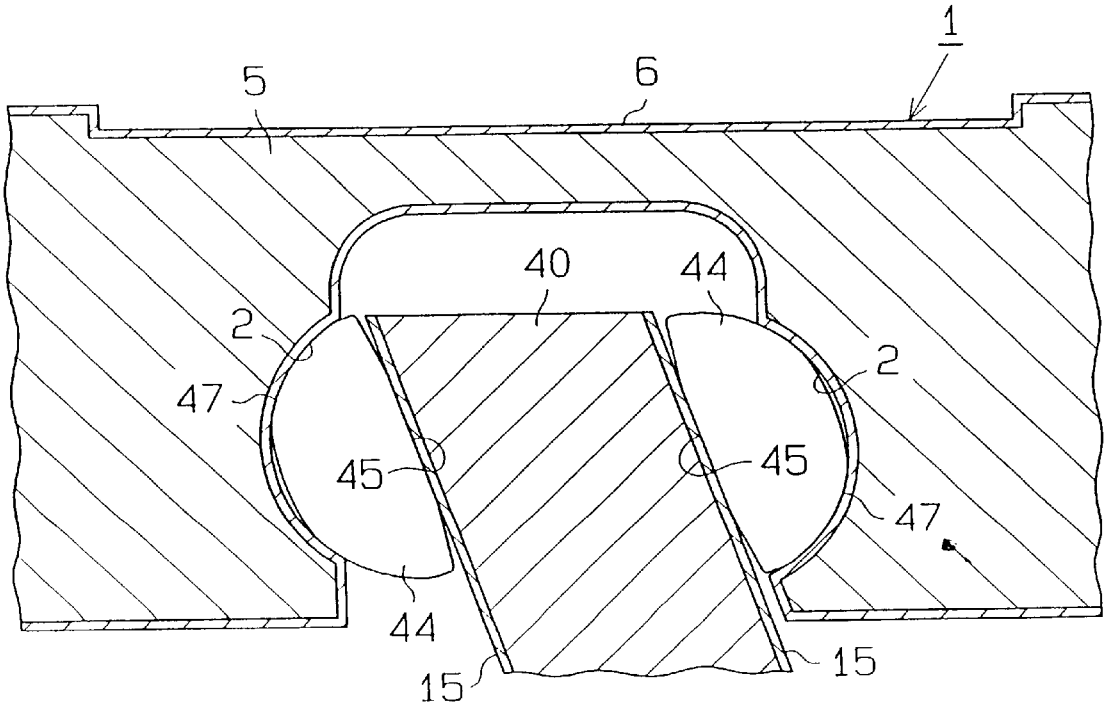
FIG. 9 is an enlarged cross-sectional view of a pertinent portion of a swash plate according to another embodiment of the invention.

(3) In the first embodiment, a coating layer 15 that contains tin as the major component is formed on each surface of the swash plate 40, which makes sliding contact with the shoes 44, as shown in FIG. 9. The composition of the coating layer 15 may be the same as that of the coating layer 6 of the piston 1. Thus, the sliding resistance between the swash plate 40 and the shoes 44 can be further reduced.

A coating layer containing tin as the major component may be formed on the sliding surface 45 of each shoe 44 instead of forming the coating layers 15 on each side of the swash plate 40. In other words, the shoe 7 in the second embodiment may be given the coating layer 11 only at the sliding surface 10, and such shoes 7 may be employed as the shoes in the first embodiment.

(4) In the first embodiment, the coating layer 6 may be formed only at the receiving recesses 2 of the pistons 1.

(5) In the second embodiment, the coating layer 11 may be formed on either the spherical surface 8 or the sliding surface 10 of each shoe 7. When the coating layer 11 is formed only on the spherical surface 8 of the shoe 7, the coating layers 15 may be formed on each side of the swash plate 40 as described in (3). When the coating layer 11 is formed only on the sliding surface of the shoe 7, the piston 1 in the first embodiment, i.e., the piston 1 having the coating layer 6, may be employed.

(6) In the first embodiment, the surface of the main body 5 of the piston 1 may be subjected to pretreatment such as alumite treatment, manganese phosphate treatment, zinc phosphate treatment or zinc plating treatment prior to formation of the coating layer 6 on the main body 5. Thus, sliding resistance of the piston 1 with respect to the shoes 44 can further be reduced.

(7) In any of the foregoing embodiments, an alumina ceramic ($Al_2O_3$) layer may be formed on the sliding surface 10 of the main body 12 of each shoe 7 and the sliding surface 45 of each shoe 44. Thus, the sliding resistance of the shoes with the swash plate 40 can further be reduced.

(8) In any of the foregoing embodiments, the ratio of tin to other metals also present in the coating layer 6 or 11 may be suitably changed depending on the desired performance of the compressor. For example, when both tin and copper exist in the coating layer 6 or 11, the content of copper is desirably changed to within the range of 0.1% by weight to 50% by weight. If the content of copper is smaller than 0.1% by weight, densification and reinforcement of the coating layer 6 or 11 cannot be fully achieved, and the effect to be brought about by incorporation of copper cannot be achieved. If the content of copper is greater than 50% by weight, the self-lubricating action of tin cannot be fully achieved, which results in increased sliding resistance.

(9) In any of the foregoing embodiments, the fluororesin powder or the molybdenum disulfide powder incorporated in the coating layer 6 or 11 as a solid lubricant may be replaced with a carbon powder, a boron nitride powder, or the like.

(10) In any of the foregoing embodiment, the coating layer 6 or 11 may not be formed by means of wet plating process such as electrolytic plating and chemical plating but may be formed utilizing a CVD method or a dry plating method such as vacuum deposition, sputtering, ion plating and PVD. When the solid lubricant described in (9) is incorporated into the coating layer 6 or 11, a composite plating method may be employed.

(11) In any of the foregoing embodiments, the thickness of the coating layer 6 or 11 may be suitably adjusted in the range of 1 to 5 $\mu$m. If the coating layer 6 or 11 has a thickness of smaller than 1 $\mu$m, the coefficient of friction cannot be sufficiently reduced. If the coating layer 6 or 11 has a thickness greater than 5 $\mu$m, a problem is likely to occur in the rigidity of the layer, and the coating layer 6 or 11 may separate.

What is claimed is:

1. A reciprocating compressor comprising:

a cylinder block containing a cylinder bore;

a drive shaft;

a cam connected to and rotated by the drive shaft;

a piston slidably housed in the cylinder bore;

a follower device located between the piston and the cam, wherein the piston is reciprocated via the follower device as the cam is rotated, wherein the follower device has at least one load bearing surface that slides with respect to a cooperative surface; and a layer containing more than 90% tin by weight formed on at least a portion of one of the load bearing surface of the follower device and the piston, wherein the layer containing tin reduces friction between itself and another surface with which it engages.

2. The compressor according to claim 1, wherein the piston is made of an aluminum-based material.

3. The compressor according to claim 1, wherein the layer containing tin is formed on the entire outer surface of the piston to reduce friction between the piston and the cylinder block and between the piston and the follower device.

4. The compressor according to claim 1 further comprising a layer containing tin formed on the surface of the cam to reduce friction between the cam and the follower device.

5. The compressor according to claim 1, wherein the layer containing tin is formed on the follower device to reduce friction between the cam and the follower device.

6. The compressor according to claim 1, wherein the layer containing tin is formed on the follower device to reduce friction between the piston and the follower device.

7. The compressor according to claim 1, wherein the layer contains at least one metal selected from the group consisting of copper, nickel, zinc, lead and indium.

8. The compressor according to claim 1, wherein the follower device is a shoe having a spherical surface, and the piston includes a recess for slidably receiving the spherical surface.

9. The compressor according to claim 1, wherein the layer contains a solid lubricant selected from the group consisting of a fluororesin powder, a molybdenum disulfide powder, a carbon powder and a boron nitride powder.

10. A reciprocating compressor comprising:

cylinder blocks containing cylinder bores;

a drive shaft rotatably supported in the cylinder blocks;

a cam connected to and rotated by the drive shaft;

a piston slidably housed in the cylinder bores;

a ferrous metal cam follower located between the piston and the cam to engage both the piston and the cam, wherein the piston is reciprocated via the cam follower as the cam is rotated; and a friction reducing coating formed on at least a portion of the cam follower, wherein the coating contains more than 90% tin by weight.

11. The compressor according to claim 10, wherein the coating is formed on the entire surface of the cam follower.

12. The compressor according to claim 10, wherein the coating contains at least one metal selected from the group consisting of copper, nickel, zinc, lead and indium.

13. The compressor according to claim 10, wherein the cam follower is a shoe having a substantially hemispherical shape with a spherical surface, and wherein the piston has a recess for slidably receiving the spherical surface.

14. The compressor according to claim 10, wherein the coating contains a solid lubricant selected from a group consisting of a fluororesin powder, a molybdenum disulfide powder, a carbon powder and a boron nitride powder.

15. A reciprocating compressor comprising:

a cylinder block containing a cylinder bores;

a drive shaft located at the center of the cylinder block;

a cam connected to and rotated integrally with the drive shaft;

a piston slidably housed in each cylinder bore, wherein each piston has a load bearing recess;

a follower device located between each load bearing recess and the cam, wherein each piston is reciprocated via the associated follower device as the cam is rotated, wherein each follower device has at least one load bearing surface that slides with respect to the load bearing recess; and a layer containing more than 90% tin by weight, formed on at least a portion of one of the load bearing surface of the follower device and the load bearing recess of the piston, wherein the layer reduces friction between the follower device and the piston.

16. The compressor according to claim 15, wherein the layer contains at least one metal selected from the group consisting of copper, nickel, zinc, lead and indium.

* * * * *